United States Patent [19]

Huntley et al.

[11] 3,986,420

[45] Oct. 19, 1976

[54] CLAMP MECHANISM AND WORKPIECE END CUTTING APPARATUS UTILIZING SAME

[75] Inventors: James R. Huntley; William Franklin Southard, both of Monroe, N.C.

[73] Assignee: Tool Service Engineering Company, Monroe, N.C.

[22] Filed: Dec. 19, 1974

[21] Appl. No.: 534,434

[52] U.S. Cl. ..... 83/435.1; 83/425.2; 83/581; 83/522

[51] Int. Cl.² ..... B27B 27/06

[58] Field of Search ..... 83/435.1, 581, 425.2, 83/522; 269/229

[56] References Cited

UNITED STATES PATENTS

| | | | |
|---|---|---|---|
| 596,400 | 12/1897 | Fuller | 83/435.1 |
| 2,362,067 | 11/1944 | Heinrich | 269/229 |
| 2,750,972 | 6/1956 | Levy | 269/229 X |
| 2,894,543 | 7/1959 | Ivy | 83/435.1 |
| 3,830,127 | 8/1974 | James | 83/435.1 |

*Primary Examiner*—Donald R. Schran
*Attorney, Agent, or Firm*—Bell, Seltzer, Park & Gibson

[57] ABSTRACT

Clamp mechanism for use in maintaining a workpiece in desired position against a stationary backstop including a clamping member mounted for free linear movement for being positioned in engagement with the workpiece regardless of the dimensions thereof and a camming and locking device for selectively engaging and camming the clamping member to apply a desired clamping force to the workpiece and for locking the clamping member against the free linear movement thereof in the cammed position. This preferred clamp mechanism may be utilized in an apparatus for cutting the ends of workpieces, e.g. mitered end picture frame moldings, and which includes a table top linearly movably mounted on a support frame and having a longitudinally extending slot therein and a saw mounted in fixed position within a portion of the table top slot. The backstop and clamp mechanism are mounted on the table top with the backstop disposed at a predetermined desired angle to the saw for clamping the workpiece on the table top for movement toward the saw for the cutting of the end thereof.

11 Claims, 8 Drawing Figures

CLAMP MECHANISM AND WORKPIECE END CUTTING APPARATUS UTILIZING SAME

BACKGROUND OF THE INVENTION

This invention relates to a clamp mechanism for maintaining a workpiece in desired position and which is characterized by a construction which applies a desired clamping force to a selected workpiece regardless of variations in dimensions of the workpiece selected and to an apparatus for cutting the ends of the workpieces at a desired angle, including the cutting of mitered end picture frame moldings, which may utilize such clamp mechanism.

In various manufacturing operations, in which a workpiece is to be clamped for performing certain operations thereon including cutting of the ends thereof to desired angles such as would be desired in the building of picture frames, a clamp mechanism is necessary for maintaining the workpiece in desired position. Heretofore, various constructions of clamp mechanisms have been proposed for clamping and maintaining a workpiece in a desired position.

However, these previously proposed clamp mechanisms have been deficient in their construction and operation (1) by the inability to compensate for variations in dimensions of the workpieces being clamped and/or (2) by the inability to apply a desired selected clamping force to the workpieces regardless of variations in dimensions thereof.

Additionally, various constructions of apparatus for cutting the ends of workpieces, including picture frame moldings, to form desired angularly cut ends, such as mitered ends, have been proposed to aid the builders of various products, including picture frames. However, all of these previously proposed workpiece end cutting apparatuses have been either complex in their construction, cumbersome for use by an operator, deficient in the flexibility thereof and/or lacked the incorporation therein of a quick acting, dimesion compensating, clamp mechanism for maintaining the workpieces in desired positions for the cutting of an angularly cut end thereon.

SUMMARY OF THE INVENTION

Accordingly, it is the object of this invention to provide a clamp mechanism for use in maintaining a workpiece in desired position against a stationary backstop and which will apply any desired clamping force to a selected workpiece regardless of variations in dimensions of the workpieces selected.

It is a further more specific object of this invention to provide an apparatus for cutting the ends of workpieces at desired angles which is non-complex in construction and may be easily operated and which includes a clamp device for applying a desired clamping force to a selected workpiece for maintaining the workpiece in position for the cutting of the end thereof at a desired angle.

It is a further more specific object of this invention to provide such an apparatus which is specifically constructed for the cutting of the ends of picture frame moldings at a 45° mitered cut.

It has been found by this invention that the above objects may be accomplished by providing a clamp mechansim for use in maintaining a workpiece in desired position against a stationary backstop as follows. A clamping member is mounted for free linear movement toward and away from the the workpiece for being positioned in engagement with the workpiece regardless of the dimensions thereof. Camming and locking means are operatively associated with the linearly movable, clamping member for selectively engaging the clamping member when the clamping member is positioned in engagement with the workpiece and for camming the clamping member a desired selected distance to apply a desired clamping force to the workpiece and for locking the clamping member against the free linear movement thereof in the cammed position thereof.

In accordance with the preferred form of the clamp mechanism of this invention, the clamping member comprises a clamping head portion for engagement with the workpiece and an elongate slide bar portion secured to the head portion at one end thereof and extending rearwardly therefrom. In this preferred embodiment, the clamp mechanism further includes a stationary mounting block means having a passageway therethrough for receiving the slide bar portion therein for mounting and guiding the clamping member for the free linear movement thereof. Further, in this preferred embodiment, the camming and locking means comprises a cam member rotatably carried by the mounting block means and having an outer, increasing radius, eccentric camming surface and a handle portion for manual rotation thereof between an inoperative position and operative positions. A cam follower is mounted for engagement with and movement by the camming surface of the cam member. Locking dog means are operatively connected to the cam follower and operatively positioned with respect to the slide bar portion of the clamping member for being moved by the cam follower into locking engagement with the slide bar portion to prevent free linear movement of the clamping member upon rotation of the cam member into an operative position and for linearly moving the locked clamping member therewith a desired distance upon further rotation of the cam member in the operative positions thereof.

By this invention, it has been found that the above, more specific objects may be accomplished by providing an apparatus for cutting the ends of workpieces, including mitered end picture frame moldings, at desired angles including the following. A stationary support frame structure is provided and a table top is linearly movably mounted on the support frame and has a longitudinally extending slot generally medially thereof. A saw, preferably of the rotating circular type, is mounted in fixed position on the support frame and positioned within a portion of the table top slot so that the table top may be moved linearly back and forth with respect thereto. An elongate backstop means is secured to the table top and disposed at a desired angle with respect to the table top slot and the saw, preferably at substantially 135° included angle for cutting mitered end picture frame moldings, for receiving one side of a workpiece thereagainst at the desired angle for movement of the table top linearly toward the saw for cutting the workpiece to form an angularly cut end thereon. A clamp mechanism, preferably of the construction described above, is mounted on the table top in spaced relation to the backstop means so as to provide on the table top a substantially unobstructed workpiece supporting area between the clamp mechansim and the backstop means for supportingly receiving the workpiece thereon. The clamp mechanism includes a clamping member mounted; for free linear movement toward and away from the backstop means for being positioned in engagement with the opposite side of the workpiece received by the backstop means regardless of the dimensions thereof and for applying a desired clamping force to the workpiece for maintaining the workpiece in position against the backstop means for cutting of the end thereof.

In a preferred form of an apparatus for cutting mitered end picture frame moldings in accordance with this invention, a pair of longitudinally extending backstop means are secured to the table top and disposed at oppositely extending, substantially 135° included angles with respect to the saw and an approximately 90° included angle with respect to each other and converging at the table top slot for selectively and consecutively receiving against the backstop means one at a time a picture frame molding to be disposed at the substantially 135° included angle with respect to the saw for movement of the table top and the molding linearly toward the saw for cutting the molding to form a substantially 45° mitered cut end thereon. In this apparatus, a pair of the above described clamp mechanisms will be mounted on the table top with a respective one of the clamp mechanisms being positioned adjacent a respective one of the backstop means. This arrangement provides a convenient operator position between the backstop means for easily inserting and removing workpieces from the apparatus and for operating the apparatus.

Further details of the specific, preferred construction of the above described clamp mechansim and apparatus for cutting the ends of workpieces will be described more specifically in the detailed description to follow.

BRIEF DESCRIPTION OF THE DRAWINGS

Some of the objects and advantages of this invention having been set forth, other objects and advantages will appear as the description proceeds, when taken in conjunction with the accompanying drawings, in which.

DESCRIPTION OF PREFERRED EMBODIMENT

Figure 1:
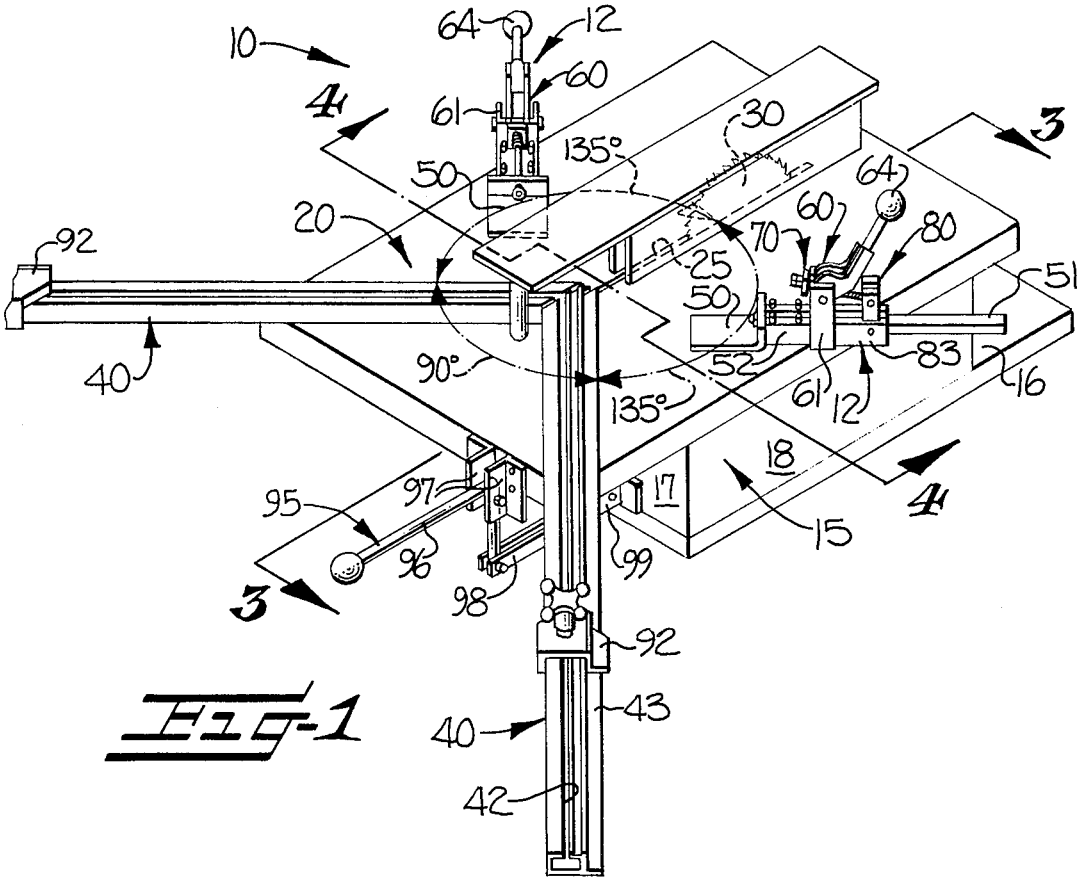
FIG. 1 is a perspective view of an apparatus in accordance with this invention for the cutting of mitered end picture frame moldings and including the clamp mechanism of this invention.

Referring now to the drawings, there is illustrated an overall apparatus 10 constructed in accordance with this invention for the cutting of mitered end picture frame moldings M and utilizing a clamp mechanism 12 constructed in accordance with this invention. While the detailed description to follow will be directed to an apparatus 10 for the cutting of mitered end picture frame moldings M utilizing the specific construction of the clamp mechansim 12 in accordance with this invention, it is to be understood that the clamp mechanism 12 may be utilized alone for the clamping and maintaining of any workpiece in desired postion for any operation and in any apparatus. Also, it is to be understood that the apparatus 10 may be broadly utilized for cutting angular ends of any workpiece and is not necessarily limited to the cutting of mitered end picture frame moldings M. Additionally, the specific construction and arrangement of the overall apparatus 10 may be utilized with clamp mechansims other than the specific clamp mechanism 12 described hereinafter.

The apparatus 10 includes, firstly, a support frame structure 15 of any convenient construction and which, as illustrated, includes a bottom wall 16, a front wall 17, side walls 18 and an intermediate generally rear wall 19. These wall members 16–19 may be constructed of any suitable material, such as metal or other material of sufficient strength for supporting the components of the apparatus 10, to be described below, and are secured together in any suitable manner, such as by welding, etc.

Figure 3:
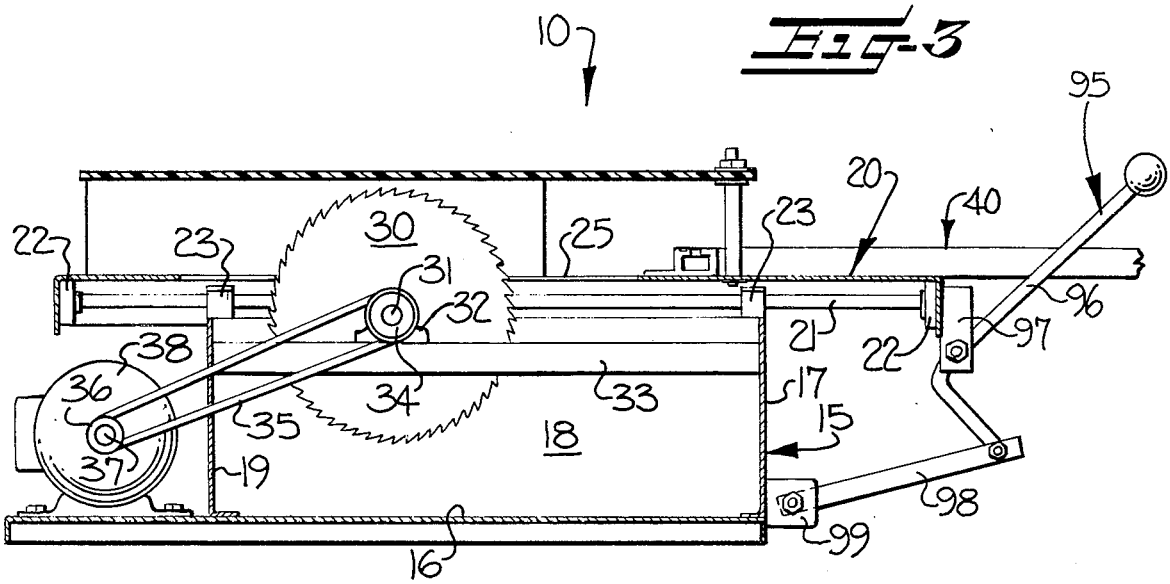
FIG. 3 is a vertical cross-sectional view taken generally along the line 3—3 of FIG. 1.
Figure 4:
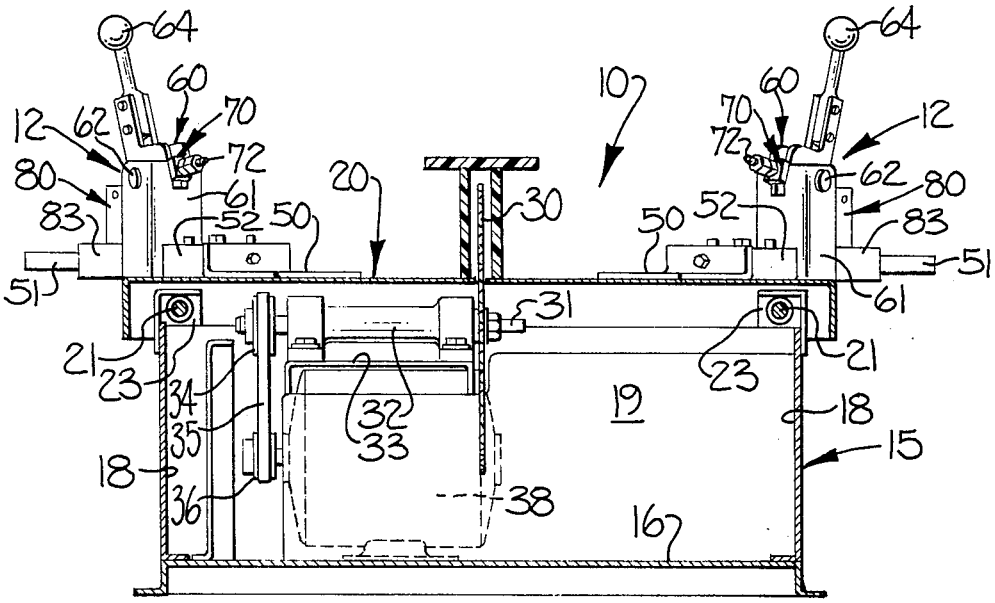
FIG. 4 is a vertical cross-sectional view taken generally along the line 4—4 of FIG. 1.

A table top 20 is linearly movably mounted on the support frame structure 15 by a pair of slide rods 21. The slide rods 21 are secured to the underside of table top 20 by block members 22. The slide rods 21 are received in and pass through suitable complimentary shaped apertures in bearing block 23 secured to the wall members of support frame 15, as shown in FIGS. 3 and 4. The bearing blocks 23 may be constructed of suitable bearing material, such as teflon or the like. The above mounting of the table top 20 on the support frame 15 allows for linear movement of the table top 20 back and forth on the support frame structure 15. The table top 20 may be constructed of any suitable material, such as metal or the like and may be of the same material as the support frame structure 15. The table top includes a longitudinally extending slot 25 therein generally medially thereof.

The apparatus 10 further includes a saw 30 mounted in fixed position on the support frame structure 15 and postioned with in a portion of the slot 25 in the table top 20 so that the table top 20 may be moved linearly back and forth with respect to the saw 30.

The saw 30 is preferably a circular saw mounted on a shaft 31 which is carried in a bearing housing 32 mounted on longitudinally extending support beams 33 secured to the walls of the support frame 1. The other end of the shaft 31 has a pulley 34 mounted thereon which receives a belt 35 which also passes around a pulley 36 carried by a shaft 37 extending from a suitable motor 38. The motor 38 is mounted on the floor 16 of the support frame structure 15. Thus, the saw 30 will be rotated by the motor 38 to provide a rotating circular saw extending partially upwardly through a portion of the longitudinally extending slot 25 and the table top 20 for movement of the table top 20 linearly back and forth with respect to the rotating saw 30.

The apparatus 10 further includes a longitudinally extending backstop means 40 and preferably a pair of backstop means 40 secured to the table top 20 and extending outwardly therefrom at oppositely extending substantially 135° included angles with respect to the saw 30 and the table top slot 25 and at approximately a 90° included angle with respect to each other. The backstop means 40 converge and are slightly spaced apart at the table top slot 25 so that the table top slot 25 passes generally medially therebetween. The backstop means 40 selectively and consecutively receive thereagainst one at a time a picture frame molding M to be disposed at the substantially 135° included angle with respect to the saw so that the table top 20 may be linearly moved toward the saw for cutting the molding disposed against the backstop means 40 to form a substantially 45° mitered cut end thereon. The above angular relationships allow an operator to conveniently stand between the backstop means 40 for ease in placement and removal of the workpieces in the apparatus 10 and for operating the apparatus 10, which was not possible with previously proposed arrangements.

While the preferred position of the backstop means 40 is at an approximate 135° angle with respect to the saw for the cutting of a 45° mitered end on a molding M received against the backstop means 40, it is to be understood that the backstop means 40 may be positioned at any desired angle with respect to the saw for the cutting of any workpiece positioned thereagainst at any desired angle for a predetermined purpose and while the backstop means 40 is illustrated in the drawings as being secured to the table top 20, it may be adjustably secured thereto for purposes of varying the angle thereof with respect to the saw. Also, if desired, a single backstop means 40 may be utilized in the apparatus 10.

The backstop means 40 may be constructed of any suitable material and of any suitable shape. As illustrated in the drawings hereof, the backstop means 40 is constructed of a generally rectangular hollow metal member having a longitudinally extending slot 42 in the upper surface thereof communicating with the hollow interior thereof and an outwardly, transversely and longitudinally extending flange 43 integrally formed on the picture frame molding receiving side thereof for aiding in the positioning of certain configurations of picture frame moldings M, such as rabbeted edges, against the side of the backstop means 40. The illustrated metal backstop member 40 is suitably secured to the table top 20 in any manner, such as by welding or the like.

The apparatus 10 further includes the clamp mechanisms 12 movably mounted on the table top 20 adjacent each of the backstop means 40 for free linear movement generally transversely toward and away from the backstop means 40 for being positioned, preferably manually, for engagement with the opposite side of the picture frame molding M received by the selected backstop means 40 regardless of the dimensions thereof and for applying a desired clamping force to the picture frame molding M for maintaining the molding M in position against the selected backstop means 40 for the cutting of the mitered end thereof.

Figure 6:
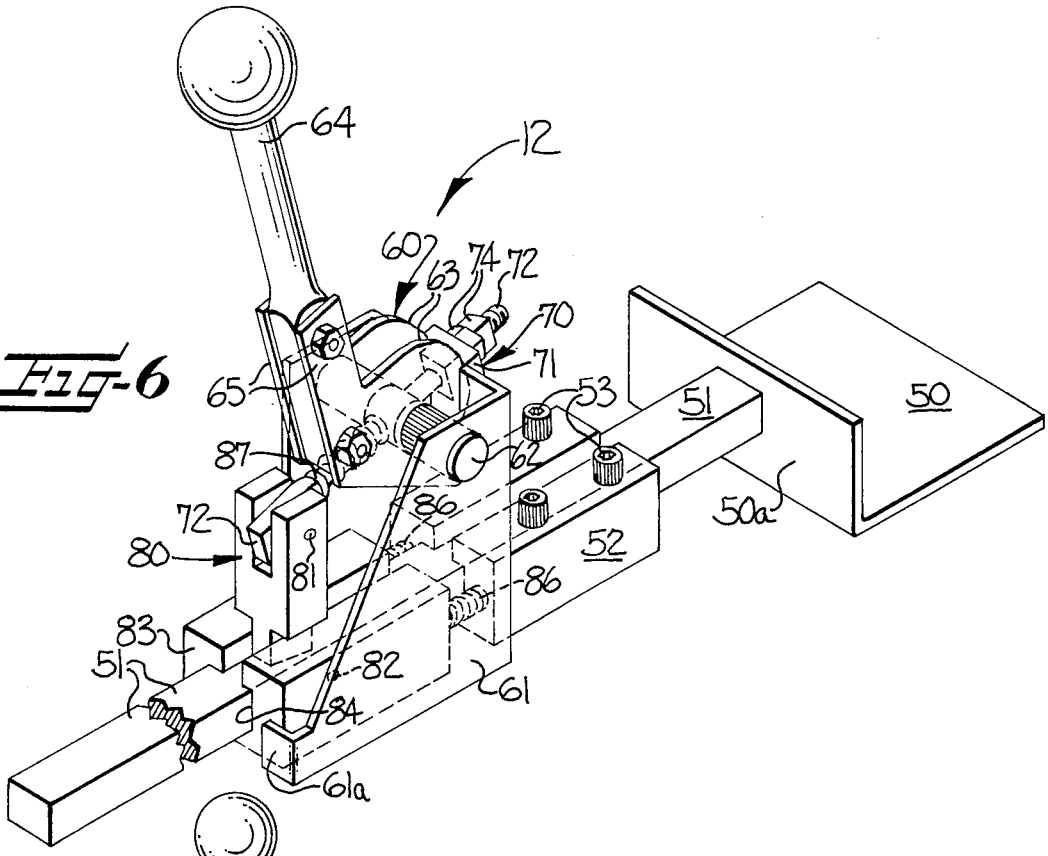
FIG. 6 is a perspective view of the clamp mechansim of this invention.
Figure 7:
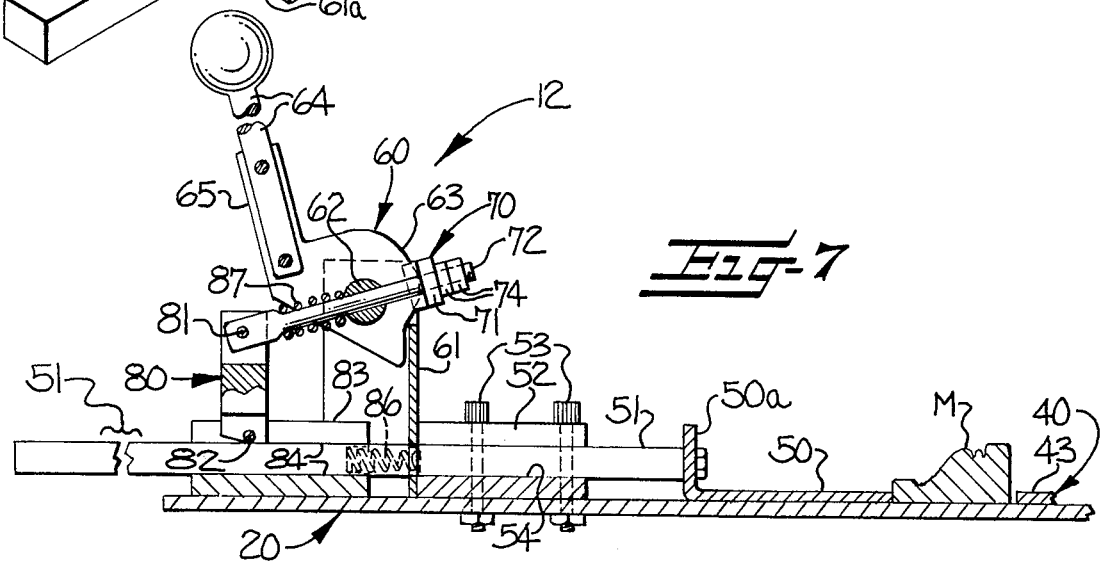
FIG. 7 is a vertical cross-sectional view taken generally along the line 7—7 of FIG. 6.
Figure 8:
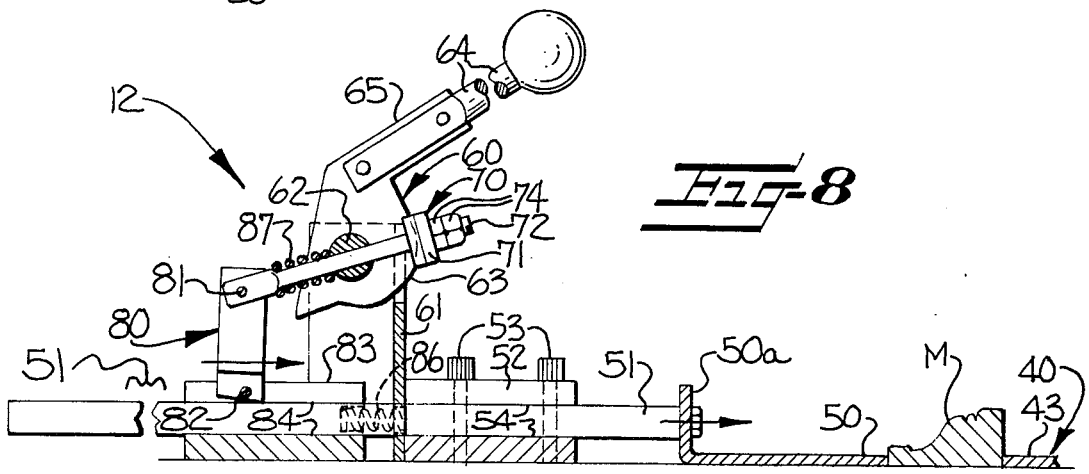
FIG. 8 is a vertical cross-sectional view, like FIG. 7, illustrating the clamp mechanism in its forwardly cammed and locked condition with a picture frame molding clamped therein.

Referring now more specifically to FIGS. 6–8, the clamp mechanism 12 comprises a clamping member including a clamping head 50 for engagement with the opposite side of the picture frame M received against the backstop means 40 and an elongate slide bar 51 secured at one end to the clamping head 50 and extending rearwardly therefrom. The clamping head may be of any suitable shape and, as illustrated herein, is in a generally angled flat plate configuration having a rear upwardly extending flange 50*a* for securement thereof to the slide bar 51.

A stationary mounting block member 52 is secured to the table top 20, such as by bolt and nut devices 53. The mounting block member 52 includes a passageway 54 extending longitudinally therethrough of a complimentary configuration to the slide bar 51 for receiving the slide bar 51 therein for mounting and guiding the slide bar 41 and the clamping head 50 for free linear movement thereof toward and away from the backstop means 40 and the molding M or other workpiece positioned thereagainst. This free linear movement of the clamping head 50 and slide bar 51 is accomplished by manual movement by an operator.

The entire clamp mechanism 12 is preferably positioned on one side of the backstop means 40 and in spaced relation thereto for movement of the clamping head 50 forwardly toward and rearwardly away from the side of the backstop means 40 receiving the molding M. This arrangement allows the clamping of any thickness molding M.

The clamp mechanism 12 further includes camming and locking means including a cam member 60 rotatably carried by the mounting block 52 through a bracket 61 secured to the rear end of the mounting block 52 and forming a part thereof and carrying a fixed stub shaft 62 upon which the cam member 60 is rotatably mounted. The cam member 60 has an outer increasing radius, eccentric camming surface 63 and includes a handle member 64 extending therefrom for manual rotation of the cam member 60 between an inoperative position, as shown in FIG. 7, and operative positions, one of which is shown in FIG. 8. The cam member 60 may be split and comprise a pair of cam plates 65 secured to each side of the handle portion 64 and mounted on the stub shaft 62 and each having camming surfaces 63.

The camming and locking means of the clamp mechanism 12 further includes a cam follower 70 mounted for engagement with and movement by the camming surfaces 63 of the cam member 60. This cam follower 70 may be adjustable and in the form of a threaded nut member 71 received on the threaded end of a shaft 72 and which overlaps the camming surfaces 63 of the split cam members 65. The shaft 72 may also receive adjustable locking nuts 74 on either side of the cam follower 71 for securing the follower 71 in desired position on the shaft 72. The shaft 72 extends through a suitable aperture or passageway in the stub shaft 62 and extends rearwardly therefrom so as to be linearly movable back and forth through the passageway in the stub shaft 62 as the cam member 60 is rotated and moves the follower 71 outwardly and inwardly.

The camming and locking means of clamp mechanism 12 also includes a locking dog 80 operatively connected to the cam follower 70 and operatively positioned with respect to the slide bar 51 for being moved by the cam follower 70 into locking engagement with the slide bar 51 to prevent the free linear movement of the slide bar and the clamping head 50 upon rotation of the cam member 60 into an operative position and for linearly moving the locked slide bar 51 and clamping head 50 forwardly therewith toward the picture frame molding M a desired distance upon further rotation of the cam member 60 in the operative positions thereof.

For this purpose, the locking dog member 80 is pivotally connected at 81 to the rearwardly extending end of the shaft 72 which may be of a flat configuration. The other end of the locking dog member 80 is pivotally connected at 82 to a slide block 83 and has an outer, generally angularly extending surface. The slide block 83 includes a passageway 84 therein for receiving the rear end of slide bar 51 and for moving relative thereto. Rearward movement of the slide block 83 is confined by an inwardly extending tab portion 61*a* of bracket 61 and is biased into the rear position thereof against the tab 61*a* by a pair of springs 86 extending between the front of slide block 83 and the rear of mounting block 52. The cam member 60 is also biased into the inoperative position thereof (FIG. 7) by a spring 87 around shaft 72.

Thus, when the head portion 50 of the clamp mechanism 12 is manually moved into engagement with the other side of molding M received against the backstop 40 by the free linear movement thereof, this position being shown in FIG. 7, the cam member 60 may be rotated from the inoperative position thereof, as shown in FIG. 7, by manually gripping the handle portion 64 and rotating the handle portion 64 downwardly into an operative position, as shown in FIG. 8. This rotation of the cam member 60 causes the cam follower 72 to move outwardly causing the shaft 72 to also move outwardly through the passageway in stub shaft 62 and causes pivotal movement of the locking dog 80 about its pivots 81 and 82 so as to engage or bite the slide bar 51 at the lower angular extending portion thereof and lock the slide bar and clamping head 50 against free linear movement. Further rotation of the cam 60 by handle 64 downwardly, as viewed in FIG. 8, in the operative positions thereof, causes further extension of the shaft 72 for outward movement of the cam follower 70 which in turn causes forward movement of the locking dog 80 which cannot pivot any further due to the engagement thereof with the slide bar 51. This in turn causes forward movement of the slide block 83 against the bias of springs 86. The forward movement of the locking dog 80 cams the slide bar 51 and clamping head 50 forwardly exerting a clamping force on the picture frame molding M against the backstop 40. Thus, a desired clamping force may be exerted by the clamp mechanism 12 in relation to the extent of rotation of the cam member 60 in the operative positions thereof after the locking dog 80 has engaged the slide bar 51.

Figure 5:
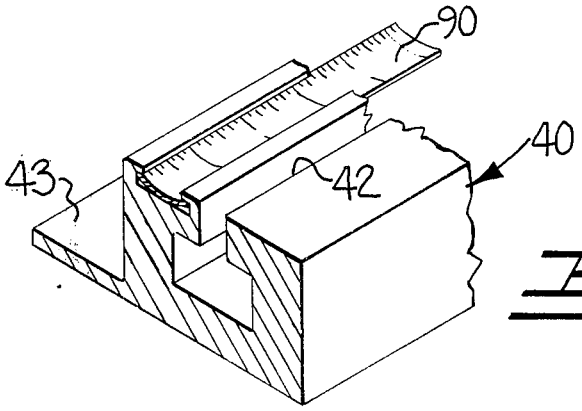
FIG. 5 is an enlarged partial cross-sectional detail through the backstop means of the apparatus of FIG. 1.

For aiding in correctly positioning the picture frame molding M against the backstop means 40, a measuring means including a ruler 90 is positioned longitudinally along the backstop means within a suitable groove formed in the middle of backstop member 40, as shown particularly in FIG. 5, so that the picture frame molding M may be positioned by an operator against the backstop member 40 and the length thereof from where the cut end is to be formed can be accurately determined. Additionally, the measuring means may include an adjustable stop device 92 slidably mounted on each of the backstop members 40 for being adjustably positioned at the desired distance away from the juncture of the backstop member 40 with the table top slot 25 and the saw 30. An operator may slide the stop device 92 along the backstop member 40 to the desired position which may be determined by the ruler 90 and secure the stop device 92 in position on the backstop member 40 so that a picture frame molding may be placed against the backstop member 40 with the end thereof in position against the stop device 92 for accurately determining the position where the cut end to be formed will be located.

Figure 2:
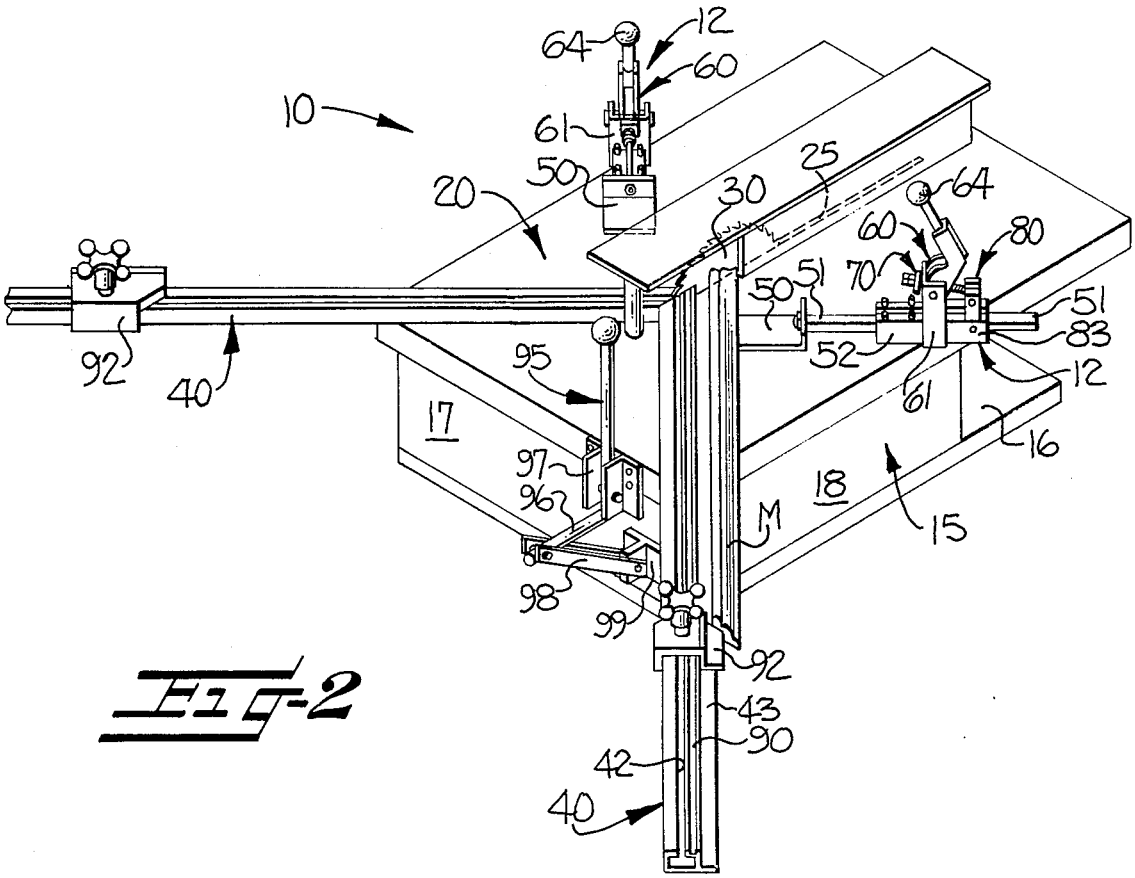
FIG. 2 is a perspective view, like FIG. 1, illustrating a picture frame molding in clamped position in the apparatus.

The apparatus 10 may further include lever means 95 operatively connected with the table top for manual engagement by the operator of the apparatus 10 for moving the table top back and forth with respect to the saw 30 for performing the cutting operation of the picture frame molding M. For this purpose, the lever means 95 includes a generally L-shaped lever 96 pivotally connected at the bend thereof to a bracket 97 secured to the table top 20 and having the other end thereof pivotally connected to a lever 98 which is connected by a bracket 99 to the stationary frame structure 15. With this construction of a lever means 95, the operator may engage the lever 96 and move the lever upwardly, as viewed in FIGS. 1 and 2, from the position of FIG. 1 to the position of FIG. 2 for linearly moving the table top 20 rearwardly toward the saw 30 for performing the cutting operation on the picture frame molding M.

Thus, with the above constructed apparatus 10 and quick locking clamp mechanism 12, an operator may easily form mitered cut ends on picture frame moldings M, as follows. A picture frame molding M would be placed on the table top 20 against one of the selected backstop means 40 at a desired position which may be determined by the use of the ruler 90 on the backstop member 40. The quick locking clamp mechanism 12 will than be clamped against the molding M received by the selected backstop member 40 by manually moving the clamping head 50 and slide bar 51 into engagement with the other side of the picture frame molding M. The camming and locking means of the clamp mechanism 12 would then be operated by rotating the cam mechanism 60 through the handle portion 64 causing the locking dog member 80 to lock the slide bar 51 and clamping head 50 against free linear movement and cause a camming action of the clamping head 50 forwardly toward the picture frame molding M by further rotation of the cam member 60 exerting a desired clamping force on the picture frame molding M.

With the picture frame molding M thus clamped between the clamping mechanism 12 and the backstop means 40, the table top 20 would be linearly moved toward the saw 30 by an operator engaging the lever means 95 and moving the table top 20 with the clamped picture frame molding thereon toward the saw 30 for the cutting of an end thereof.

The thus cut picture frame molding M would be removed from the clamping mechanism 12 and placed on the table top 20 against the other backstop member 40 in desired measured position, as discussed above, and the other clamp mechanism 12 would be engaged therewith, as discussed above. The cutting operation would be repeated for cutting of the other end of the picture frame molding M to form a mitered cut end on each end thereof and providing a picture frame molding having two mitered cut ends and being of a desired measured length.

Thus it may be seen, that this invention has provided a quick locking clamp mechanism for maintaining a picture frame molding or any desired workpiece in position and which may exert a desired clamping force on the picture frame molding, along with an apparatus for cutting a mitered or any angularly related cut end on a picture frame molding or other workpiece, which overcome the problems presented with previously proposed apparatus.

In the drawings and specification, there has been set forth a preferred embodiment of the invention, and although specific terms are employed, they are used in a generic and descriptive sense only and not for purposes of limitation.

We claim:

1. An apparatus for cutting the ends of workpieces at desired angles comprising:

a support structure;

a table top mounted for linear movement on said support structure and having an elongate slot therein extending longitudinally along the direction of linear movement of the table top;

a saw carried by said support structure and extending through the elongate slot of said table top, said table top being thereby adapted to be moved linearly back and forth with respect to the saw;

elongate backstop means secured to said table top and disposed at a predetermined angle with respect to said slot and the saw extending therethrough, said backstop means being adapted for receiving one side of a workpiece thereagainst and positioning the same at a desired angle with respect to said saw to facilitate forming an angularly cut end on the workpiece upon linear movement of said table top; and a clamp mechanism mounted on said table top in spaced relation to said backstop means so as to provide on said table top a substantially unobstructed workpiece-supporting area between said backstop means and said clamp mechanism for supportingly receiving the workpiece thereon, said clamp mechanism including a clamping member mounted for free linear movement toward and away from said backstop means and adapted for being positioned in engagement with the opposite side of the workpiece received by said backstop means regardless of the dimensions of the workpiece, and camming and locking means cooperating with said clamping member and operable for camming said clamping member toward the workpiece to apply a clamping force to the workpiece, and for locking said clamping member in the cammed position thereof for maintaining the workpiece in position against said backstop means for facilitating cutting of the workpiece.

2. An apparatus, as set forth in claim 1, in which said backstop means includes measuring means carried therealong and measuring the length of the workpiece for providing a convenient reference to an operator of the apparatus for determining the position on the workpiece in which the cut is to be formed.

3. Apparatus, according to claim 1, further including means connected with said table top for manual engagement by the operator of said apparatus for moving said table top linearly back and forth with respect to said saw for performing the cutting operation of the workpiece.

4. An apparatus, as set forth in claim 1, in which said clamping member comprises a clamping head portion adapted for engagement with the workpiece and an elongate slide bar portion secured to said head portion at one end thereof and extending rearwardly therefrom, said clamp mechanism further includes a stationary mounting block secured to said table top and having a passageway therethrough for receiving said slide bar portion therein for mounting and guiding said clamping member for the free linear movement thereof, and said camming and locking means comprises a cam member rotatably carried by said mounting block and having an outer increasing radius eccentric camming surface and a handle portion for manual rotation thereof between an inoperative position and operative positions, a cam follower mounted for engagement with and movement by said camming surface of said cam member, and locking dog means operatively connected to said cam follower and operatively positioned with respect to said slide bar portion of said clamping member for being moved by said cam follower into locking engagement with said slide bar portion to prevent free linear movement of said clamping member upon rotation of said cam member into an operative position and for linearly moving said locked clamping member therewith toward the workpiece a desired distance upon further rotation of said cam member in the operative positions thereof.

5. An apparatus for cutting mitered end picture frame moldings comprising:

a support structure;

a table top mounted for linear movement on said support structure and having an elongate slot therein extending longitudinally along the direction of linear movement of the table top;

a rotating circular saw carried by said support structure and extending through the elongate slot of said table top, said table top being thereby adapted to be moved linearly back and forth with respect to the saw;

elongate backstop means secured to said table top and disposed at a substantially 135 degree included angle with respect to said slot and the saw extending therethrough, said backstop means being adapted for receiving one side of a picture frame molding thereagainst and positioning the same with respect to said saw to facilitate forming a substantially 45 degree mitered cut end on the picture frame molding upon linear movement of said table top; and a clamp mechanism mounted on said table top opposite said backstop means and in spaced relation thereto so as to provide on said table top a substantially unobstructed area between said backstop means and said clamp mechanism for supportingly receiving the picture frame molding thereon, said clamp mechanism including a clamping member mounted for free linear movement toward and away from said backstop means and adapted for being positioned in engagement with the opposite side of the picture frame molding received by said backstop means and for clamping the picture frame molding in position against said backstop means for facilitating cutting of the mitered end thereof.

6. An apparatus, as set forth in claim 5, in which said clamping member comprises a clamping head adapted for engagement with the picture frame molding, and an elongate slide bar secured to said head at one end thereof and extending rearwardly therefrom, and wherein said clamp mechanism also includes a stationary mounting block secured to said table top and having a passageway therethrough for receiving said slide bar therein for mounting and guiding said slide bar and said clamping head for free linear movement thereof toward and away from said backstop means and the molding received thereby, a cam member rotatably carried by said mounting block and having an outer increasing radius eccentric camming surface and means for manual rotation thereof between an inoperative position and operative positions, a cam follower mounted for engagement with and movement by said camming surface of said cam member, and locking dog means operatively connected to said cam follower and operatively positioned with respect to said slide bar for being moved by said cam follower into locking engagement with said slide bar to prevent the free linear movement of said slide bar and said clamping head upon rotation of the cam member into an operative position and for linearly moving said locked slide bar and clamping head therewith toward the picture frame molding a desired distance upon further rotation of said cam member in the operative positions thereof.

7. An apparatus, as set forth in claim 5, in which said backstop means includes measuring means carried therealong for measuring the length of the picture frame molding for providing a convenient reference to the operator of the apparatus for determining the position on the picture frame molding in which the mitered end cut is to be formed on one end thereof.

8. An apparatus, as set forth in claim 7, in which said measuring means comprises a ruler mounted on and extending along said backstop means and an adjustable gauge stop device mounted on said backstop means for being adjustably positioned at a desired position along said ruler for receiving the other end of the picture frame molding and positioning the molding for cutting a mitered end on the one end thereof.

9. An apparatus, according to claim 5, further including lever means operatively connected with said table top and said stationary support frame for manual engagement by an operator of said apparatus for moving said table top linearly back and forth with respect to said saw for performing the cutting operation of the picture frame molding.

10. An apparatus for cutting mitered end picture frame moldings comprising:

a support structure;

a table top mounted for linear movement on said support structure and having an elongate slot located medially thereof and extending longitudinally along the direction of linear movement of the table top;

a saw carried by said support structure and extending through the elongate slot of said table top so that said table top may be moved linearly back and forth with respect to the saw;

a pair of elongate backstops secured to said table top and disposed at oppositely extending substantially 135° included angles with respect to said slot and the saw extending therethrough and an approximately 90° included angle with respect to each other and converging at said slot, said backstops respectively being adapted for receiving, one at a time, one side of a picture frame molding thereagainst and positioning the same at the substantially 135° angle with respect to said saw to facilitate forming a substantially 45° mitered cut end on the picture frame molding upon linear movement of said table top; and a pair of clamp mechanisms mounted on said table top respectively opposite said pair of backstops and in spaced relation thereto so as to provide on said table top substantially unobstructed areas between each of said backstops and said clamp mechanisms, for supportingly receiving the picture frame molding thereon, each of said clamp mechanisms including a clamping member mounted for free linear movement toward and away from one of said backstops and adapted for being positioned in engagement with the opposite side of the picture frame molding received by said backstop and for clamping the picture frame molding in position against said backstop for facilitating cutting of the mitered end thereof.

11. An apparatus, as set forth in claim 10, in which each of said clamping members comprises a clamping head for engagement with the picture frame molding, and an elongate slide bar secured to said head at one end thereof and extending rearwardly therefrom, and wherein said clamp mechanism also includes a stationary mounting block secured to said table top and having a passageway therethrough for receiving said slide bar therein for mounting and guiding said slide bar and said clamping head for free linear movement thereof toward and away from said backstop means and the molding received thereby, a cam member rotatably carried by said mounting block and having an outer increasing radius eccentric camming surface and means for manual rotation thereof between an inoperative position and operative positions, a cam follower mounted for engagement with and movement by said camming surface of said cam member, and locking dog means operatively connected to said cam follower and operatively positioned with respect to said slide bar for being moved by said cam follower into locking engagement with said slide bar to prevent the free linear movement of said slide bar and said clamping head upon rotation of the cam member into an operative position and for linearly moving said locked slide bar and said clamping head therewith toward the picture frame molding a desired distance upon further rotation of said cam member in the operative positions thereof.

* * * * *